United States Patent [19]

Larson

[11] Patent Number: 5,022,108

[45] Date of Patent: Jun. 11, 1991

[54] WATERBED MATTRESS WITH HEATER PAD POCKET

[76] Inventor: Lynn D. Larson, 1052 N. Lakeshore Dr., Lincoln, Nebr. 68528

[21] Appl. No.: 594,077

[22] Filed: Oct. 9, 1990

[51] Int. Cl.[5] ..... A47C 27/08

[52] U.S. Cl. ..... 5/422; 5/451; 219/217; 219/528; 392/443

[58] Field of Search ..... 5/422, 451, 452, 450; 219/217, 528, 529, 10.57; 392/443

[56] References Cited

U.S. PATENT DOCUMENTS 2,064,248 12/1936 Doyan ..... 392/443

2,178,397 10/1939 Larkey ..... 392/443

2,842,651 7/1958 Neely ..... 5/422

4,233,492 11/1980 McMullan et al. ..... 5/422

*Primary Examiner*—Alexander Grosz

*Attorney, Agent, or Firm*—John A. Beehner

[57] ABSTRACT

A waterbed mattress apparatus adapted to increase waterbed heting mat efficiency. The apparatus includes a waterbed mattress having a mat receiving opening therein and mat receiving pocket having an open end and a closed end, the open end sealed to the mat receiving opening and situated inside the mattress. The pocket has a flotation device to cause the receiving pocket to float in the fluid contained by the mattress.

10 Claims, 2 Drawing Sheets

WATERBED MATTRESS WITH HEATER PAD POCKET

BACKGROUND OF THE INVENTION

The present invention is directed generally to waterbeds and more specifically to a waterbed apparatus for more efficiently heating the water contained therein.

Waterbeds have in recent years, come into widespread use throughout the country. A typical waterbed consists of a water filled mattress supported within a rigid frame. Although early users of waterbeds were primarily younger people attracted by the novelty and low cost of the apparatus, the use of waterbeds has now spread to a wider range of consumers. Perhaps the most important reason for the popularity of waterbeds is that waterbed mattresses provide uniform sleeping support and eliminate pressure points on which most of a person's weight rests when reclining on conventional sleeping surfaces. In addition, the co-action of the water and the waterbed mattress produces a floating sensation that enables greater comfort and more restful sleep.

Waterbed manufacturers have been very innovative in providing improvements such as waterbed heaters, elevated frames, and improved bedding material which make waterbeds much more acceptable in the conventional bedding market. However, a problem with waterbed mattresses presently on the market is the inefficiency of heaters in raising the temperature of the water contained within the mattress. This inefficiency is a result of the way in which current mattresses utilize the water heaters. Currently a heating mat (analogous in many respects to a conventional heating pad) is placed below the waterbed mattress, between the mattress and the frame. Consequently, the heating mat is simultaneously in heat transfer contact with both the frame and the mattress. As a result of this simultaneous contact, a significant portion of the heat generated by the mat is absorbed by the frame. Since the heat absorbed by the frame is wasted, additional energy is required to heat the water in the mattress to the desired temperature. The consumer is penalized for this inefficiency with higher electric rates and a longer wait for the water temperature to reach the desired level. The cost of heating the water is therefore lowered and the time required to raise the temperature of the water is decreased.

Further objectives of the present invention are to provide a heating apparatus which is easy to install and use, which is durable but which is inexpensive to construct.

SUMMARY OF THE INVENTION

The present invention teaches a novel waterbed mattress apparatus for increasing the efficiency of a waterbed heating mat.

The waterbed mattress apparatus includes a mattress with walls defining a fluid tight chamber, a mat receiving opening through one wall and a pocket for receiving the mat which is sealed to the opening and which is situated within the mattress. The pocket is capable of collapsing in response to the fluid pressure exerted by the fluid in the mattress. The collapsing action of the pocket places the heating surfaces of the heating mat in a heat transfer relation with the fluid within the mattress. The heater mat receiving pocket may further include a flotation means attached thereto, causing the pocket to float in the mattress contained fluid.

DESCRIPTION OF THE PREFERRED EMBODIMENT

Figure 1:
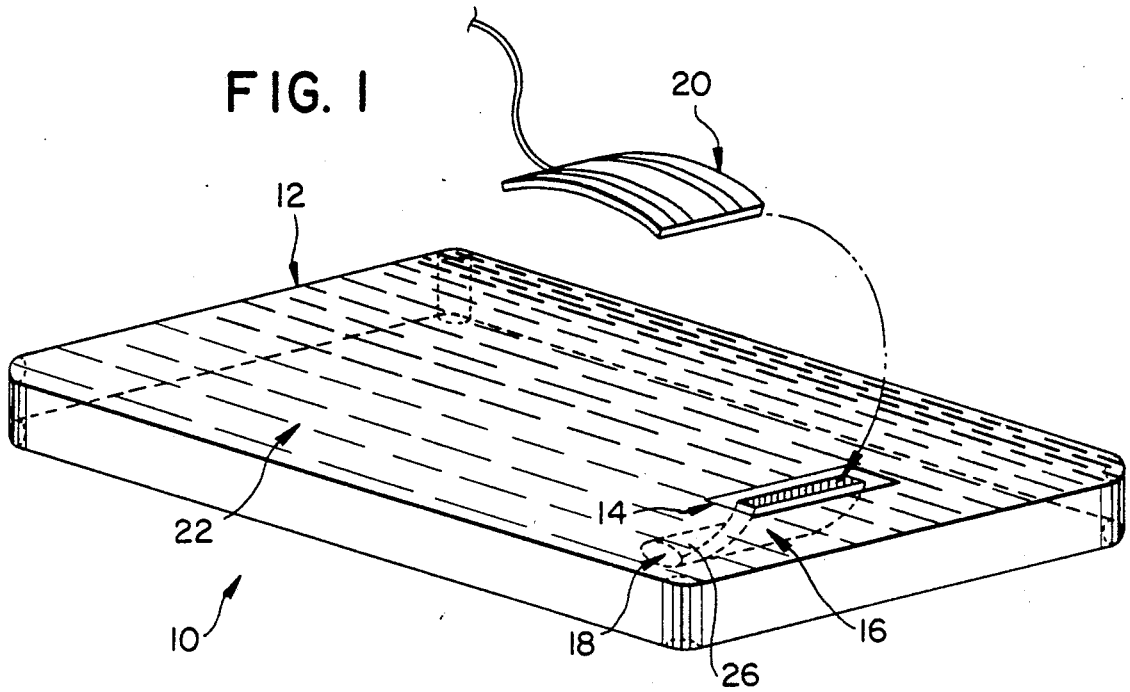
FIG. 1 is a rear quarter elevational view of the waterbed mattress underside showing the placement of the heater mat receiving opening, the attachment of the heater mat receiving pocket and the placement of the heating mat therein.
Figure 2:
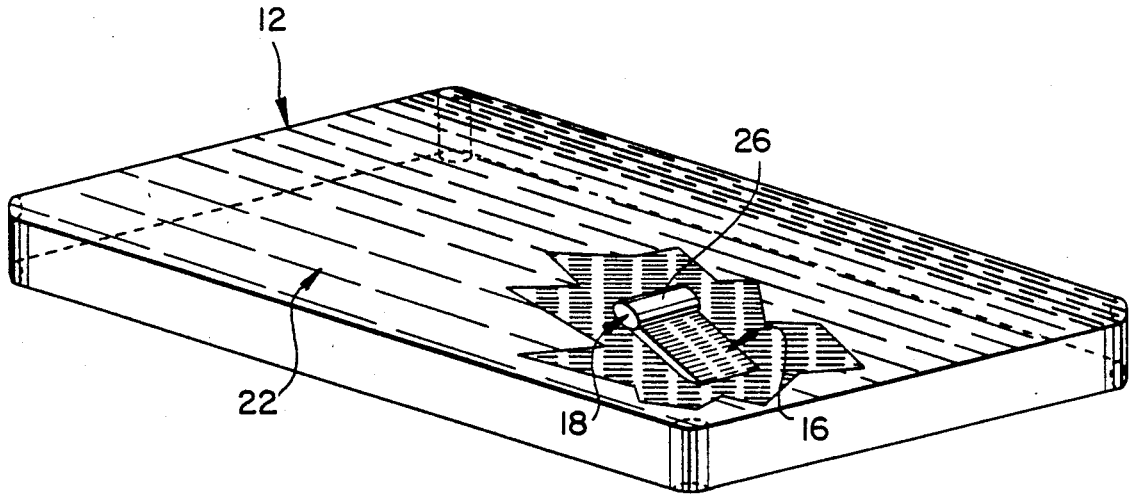
FIG. 2 is a rear quarter elevational view of the mattress top side showing the location of the pocket, sleeve and floating core within the mattress.
Figure 3:
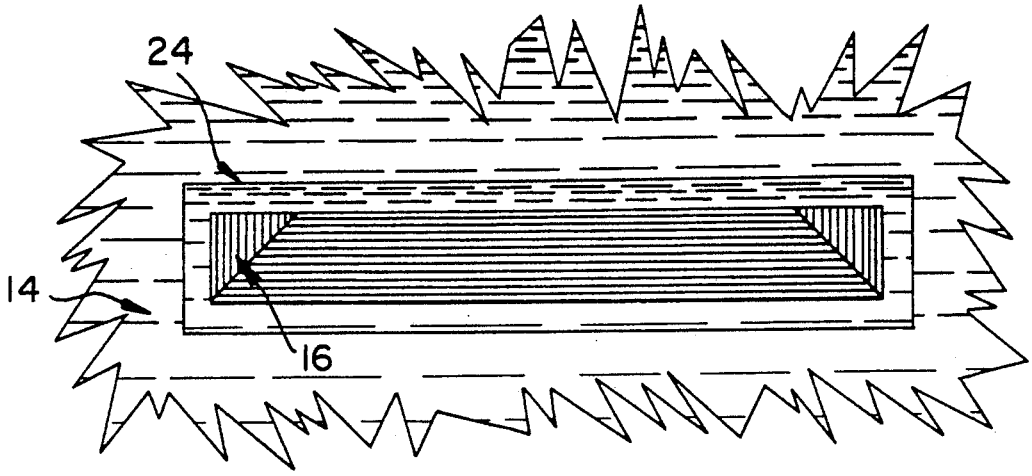
FIG. 3 is a front view of the heater mat receiving opening showing its generally rectangular shape.
Figure 4:
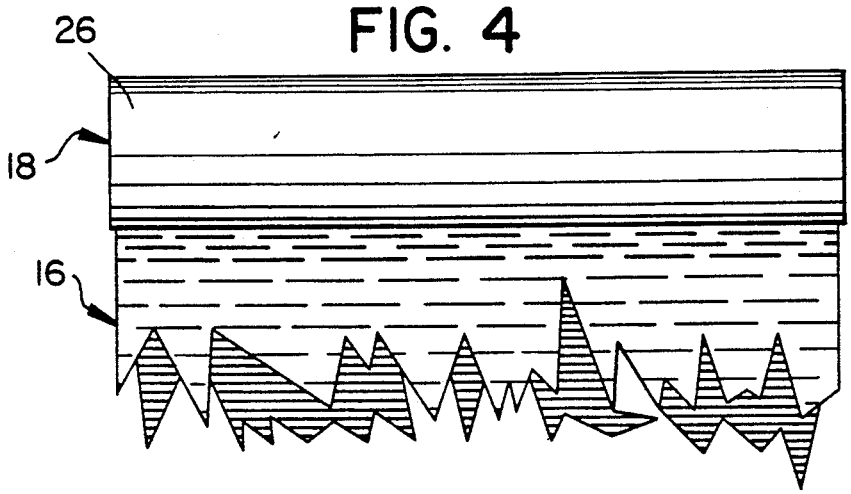
FIG. 4 is a front view of the flotation end of the pocket showing the sleeve containing the float core.
Figure 5:
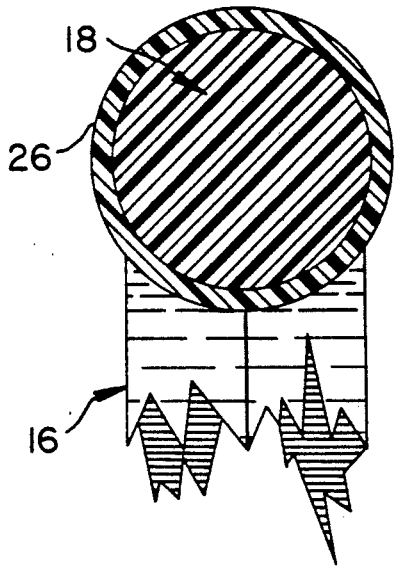
FIG. 5 is a side view of the flotation end of the pocket showing clearly the sleeve and floating core contained therein.

The apparatus of the present invention is best illustrated in FIG. 1. As shown in the figure, the waterbed mattress apparatus 10 includes a fluid containing chamber 12. The chamber 12 has a generally rectangular heater mat receiving opening 14 through one wall of the chamber 12. In the preferred embodiment, the opening 14 is placed at substantially the foot portion of the bottom side of the chamber 12. Also, shown in the figure is the heater mat receiving pocket 16. The pocket 16 is situated to be inside the mattress and has opposite open and closed ends. The open end of the pocket 16 is registered with and operatively sealed to the opening 14 using a thermal seal or the like. This allows a heating mat 20 to be inserted into and retrieved from the pocket 16. In the preferred embodiment, the pocket 16 is constructed of vinyl but other materials such as rubber or plastic could be used as long as it was waterproof, flexible and sturdy. In addition to being constructed of flexible material, the pocket 16 has dimensions which are substantially the same as the heating mat 20 being received therein. The size and material of the pocket 16 allow it to collapse against a mat 20 inserted therein, in response to the pressure of the fluid 22 contained in the mattress, thereby placing the mat 20 in a heat transfer relation with the fluid 22. The pocket may be formed of the same flexible sheet material used for construction of the waterbed mattress chamber 12.

Attached to the pocket 22, is a flotation sleeve 26. The flotation sleeve 26 and its attachment to the pocket 22 is best seen in 1, 4, and 5. In the preferred embodiment, the sleeve 26 is attached to the closed end of the pocket 22. The sleeve 26 is constructed to hold a flotation core 18 therein. In the preferred embodiment, the core 18 is constructed of foam but could be any sufficiently buoyant material. The buoyant action of the core 18 and its attachment to the closed end of the receiving pocket 16, causes the pocket 16 to float in the fluid 22 contained within the mattress 12. The flotation of the pocket 16 and placement of both surfaces of the mat 20 in heat transfer relation with the fluid 22, is responsible for the increase in watt density of the mat 20 and resulting increase in heater efficiency.

Although the figures show a single pocket, it is within the scope of this disclosure that a plurality of such pockets could be used in a single mattress to effect different heating for different mattress sections.

Whereas the invention has been shown and described in connection with a preferred embodiment thereof, it is apparent that many modifications, additions and substitutions may be made which are within the intended broad scope of the appended claims. For example, the number and placement of heater mat receiving pockets may be varied and the form and placement of the flotation device on the pocket are likewise variable to accommodate both functional and economic constraints.

I claim:

1. A waterbed mattress adapted to increase the heating efficiency of a waterbed heater mat, said mattress comprising, top, bottom, head, foot and opposite side walls interconnected to define a fluid tight chamber, a heater mat receiving opening through one wall of said mattress, a heater mat receiving pocket situated within said mattress and having opposite closed and open ends, the open end of said pocket being registered with said opening and operatively sealed to the periphery thereof such that said mat may be inserted into and removed from said pocket through said opening without exposure to fluid within the mattress, said pocket adapted to collapse against opposite surfaces of a heater mat inserted therein in response to fluid pressure within the mattress whereby both surfaces of a heater mat are in heat transfer relation with fluid in the mattress by thermal conduction through said pocket.

2. The invention of claim 1 wherein said receiving pocket further comprises a flOtation means.

3. The invention of claim 2 wherein said flotation means comprises a sleeve on said pocket and a floating core contained therein.

4. The invention of claim 3 wherein said sleeve is adjacent the closed end of said pocket.

5. The invention of claim 4 wherein the floating core is constructed of foam.

6. The invention of claim 5 wherein the dimensions of said heater mat receiving pocket are substantially the same as the mat being received therein.

7. In combination, a waterbed mattress having a top, bottom, head, foot and opposite side walls interconnected to define a fluid tight chamber, a heater mat receiving opening through one wall of said mattress, a heater mat receiving pocket situated within said mattress and having opposite closed and open ends, the open end of said pocket being registered with said opening and operatively sealed to the periphery thereof such that said mat may be inserted into and removed from said pocket through said opening without exposure to fluid within the mattress, said pocket adapted to collapse against opposite surfaces of a heater mat inserted therein in response to fluid pressure with the mattress whereby both surfaces of a heater mat are in heat transfer relation with fluid in the mattress by thermal conduction through said pocket.

8. The combination of claim 7 wherein said receiving pocket further comprises a flotation means.

9. The combination of claim 8 wherein said flotation means comprises a sleeve adjacent the closed end of said pocket and a floating core constructed of foam contained within said sleeve.

10. The combination of claim 9 wherein the dimensions of said heater mat receiving pocket are substantially the same as the mat being received therein.

* * * * *